US005437463A

United States Patent [19]

Fromm

[11] Patent Number: 5,437,463

[45] Date of Patent: Aug. 1, 1995

[54] TARGET GAME APPARATUS

[76] Inventor: Wayne G. Fromm, 3500 Bathurst Street, Toronto, Ontario, Canada, M6A 2C6

[21] Appl. No.: 195,389

[22] Filed: Feb. 14, 1994

[51] Int. Cl.[6] ..... F41J 5/08; F41G 3/26

[52] U.S. Cl. ..... 273/310; 434/20; 434/21; 434/22

[58] Field of Search ..... 273/310–312; 434/21, 22, 20

[56] References Cited

U.S. PATENT DOCUMENTS

| | | | |
|---|---|---|---|
| 2,082,218 | 6/1937 | Radtke et al. | 273/310 |
| 2,241,670 | 5/1941 | McMaster | 273/310 |
| 2,269,256 | 1/1942 | Eakins | 273/310 |
| 4,257,612 | 3/1981 | Villa | 273/310 |
| 4,802,675 | 2/1989 | Wong et al. | 273/310 |
| 4,828,525 | 5/1989 | Okana | 446/175 |
| 4,844,474 | 7/1989 | Schaub | 273/310 |
| 4,865,575 | 9/1989 | Rosenthal | 446/175 |
| 4,874,343 | 10/1989 | Rosenthal | 446/175 |
| 5,013,276 | 5/1991 | Garfinkel | 446/14 |
| 5,158,492 | 10/1992 | Rudell | 446/175 |
| 5,228,879 | 7/1993 | Fromm | 446/219 |

*Primary Examiner*—Benjamin H. Layno
*Attorney, Agent, or Firm*—John C. Thompson

[57] ABSTRACT

A game apparatus which resembles a shooting gallery, the apparatus including a gun (10) for projecting an electromagnetic beam such as an infrared light beam (22) and a target assembly (12) which includes a plurality of targets (82). Normally the targets are not visible, being concealed behind a two-way mirror (80), but during the operation of the game first one and then another target will become visible for a brief period of time as each target is illuminated by an illumination device (84), there being one illuminating device for each target. Each target has associated with it a beam receiver (86). If the electromagnetic beam strikes a target when it is illuminated, the associated beam receiver will cause a score to be registered due to the operation of additional electronics associated with the target assembly. The target assembly includes a case which has a base portion (46) and a movable portion (48) hinged to the base, the movable portion supporting the plurality of targets, and the base portion capable of being supported on a table top or the like so that a player P may play the game when either sitting or standing.

8 Claims, 4 Drawing Sheets

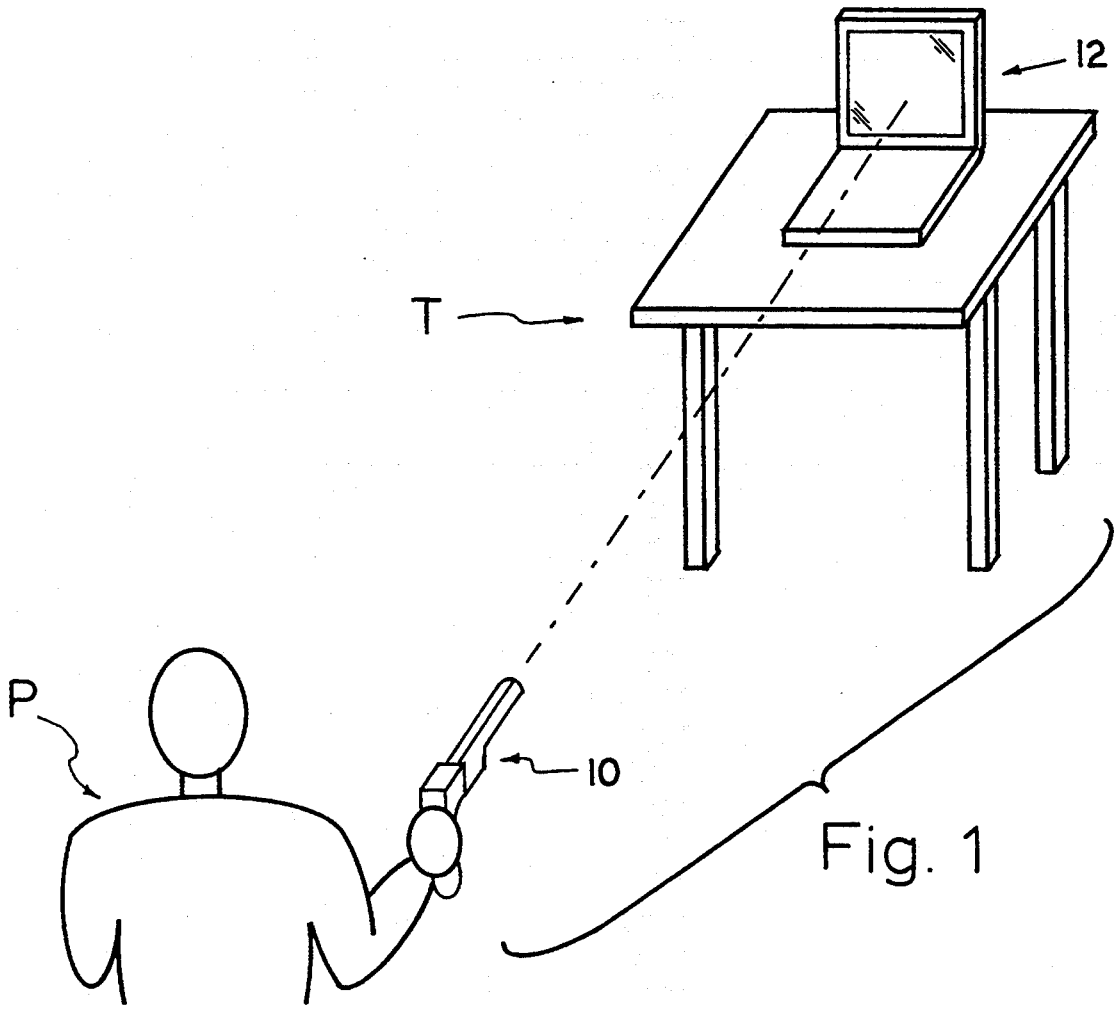
Fig. 1
Fig. 2
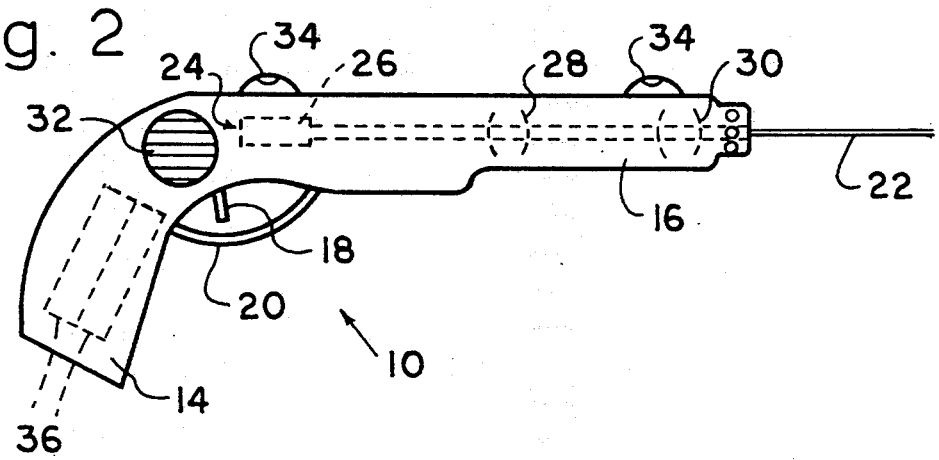

TARGET GAME APPARATUS

TECHNICAL FIELD

The present invention relates generally to a game apparatus, and more particularly to a target game apparatus which resembles a shooting gallery, the apparatus including a device such as a gun for projecting an electromagnetic beam and a target assembly which includes a plurality of targets. Normally the targets are not visible, but during the operation of the game first one and then another target will become visible for a brief period of time as they are sequentially illuminated. Each target has associated with it a beam receiver. If the electromagnetic beam strikes a target when it is illuminated the associated beam receiver will cause a score to be registered due to the operation of additional electronics associated with the target assembly.

BACKGROUND OF THE INVENTION

A video arcade game distributed by Konami and entitled "LETHAL ENFORCER" has a shooting gallery design in that it sequentially projects one or more individual target images at differing locations on a cathode ray screen which may be shot at by a gun which emits an electromagnetic beam. During the operation of the arcade game when the gun is fired at a target image, a score or hit will be recorded if the beam strikes a target image. This game, like most other video arcade games, is relatively expensive.

Less expensive toys are know which include a device for projecting a beam of light or other form of electromagnetic radiation, and an object which may be struck by the light beam. Various examples are shown in U.S. Pat. Nos. 4,828,525, 4,844,474, 4,865,575, 4,874,343, 5,013,276 and 5,158,492, the first four utilizing a gun to project a light beam at a single target, and the last two illustrating cameras instead of guns which project electromagnetic beams, also at a single target. In any event, none of the toys shown in the various patents set forth above disclose a single target assembly which includes a plurality of targets, not all targets being visible at the same time, the target assembly also indicating a score when a selected target is hit.

In addition to the foregoing patents, U.S. Pat. No. 5,228,879 discloses a hand-held mirror assembly in which a plurality of different images may be illuminated in either a random or in a programmed sequence, each of the images preferably having a voice associated with it. However, the various images of this patent are not targets, and even if they were fired at, there is no means to determine whether on not they have been hit, and no means to keep score.

OBJECTS OF THE INVENTION

It is an object of the present invention to provide a target game apparatus which includes a device, such as a gun, which is capable of projecting an electromagnetic beam, such as an infrared light beam, and a target assembly having a plurality of targets which are not visible except when illuminated, the target assembly further including a plurality of illuminating means for the targets, there being one illuminating means for each target, a receiver means for each target which is operable when the target is illuminated to register a hit from the beam projected by the device, switching means for initiating the operation of selected illuminating means during a game, and scoring means so that a player may know whether or not an illuminated target has been hit.

It is a further object of the present invention to provide such a apparatus where each target is concealed behind a two-way mirror except when an associated illumination means is caused to be operated.

It is yet another object of the present invention to provide such a apparatus wherein each of the targets is a transparent image mounted on or behind the back surface of a two-way mirror.

It is yet another object of the present invention to provide such a apparatus wherein the target assembly includes a case which has a base portion and a movable portion hinged to the base, the movable portion supporting the plurality of targets, and the base portion capable of being supported on a table top or the like so that a player may play the game when either sitting or standing.

The foregoing objects and other objects and advantages of the present invention will become more apparent after a consideration of the following detailed description taken in conjunction with the accompanying drawings in which a preferred form of the present invention is illustrated.

BRIEF DESCRIPTION OF THE DRAWINGS

FIG. 1 is a view of the target game apparatus of this invention, the apparatus including a gun which can project an electromagnetic beam and a target assembly including scoring means and a plurality of individual targets which may be selectively illuminated.

FIG. 2 is a detail view of the gun shown in FIG. 1.

DETAILED DESCRIPTION

Figure 3:
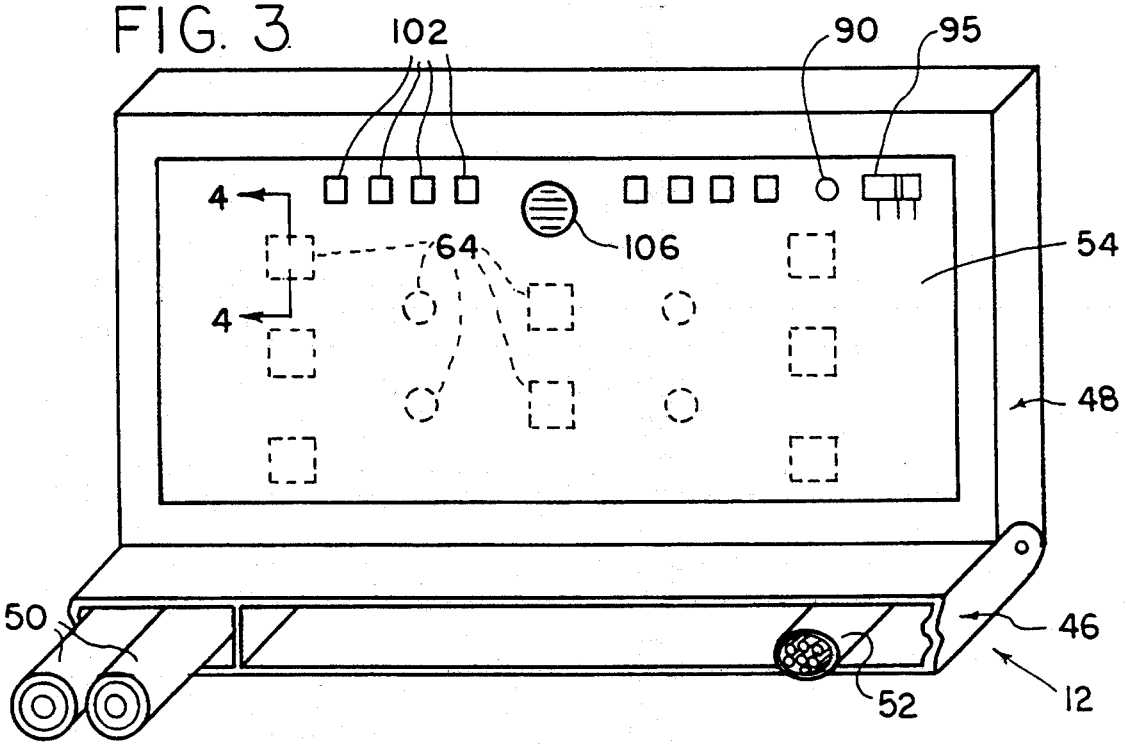
FIG. 3 is an enlarged view of the target assembly shown in FIG. 1, a portion being broken away.

With reference first to FIG. 1, the target game apparatus of this invention includes, as its two principal components, a gun indicated generally at 10, and a target assembly indicated generally at 12. The gun is held by a player P, and the target assembly is shown resting upon a table T. With reference to the target assembly, in the following description front will mean the direction facing the player, rear the direction away from the player, and other directional terms will have their normal meaning with reference to the above and to the drawings. In the embodiment illustrated in FIG. 1, the player P, who may be in either a sitting or standing position, will pick up the gun 10 and fire it in such a manner that the beam from the gun will strike targets in the target assembly as they are selectively illuminated during the operation of a game.

With reference now to FIG. 2, the gun includes a handle 14, a barrel 16, and a trigger 18 mounted within a trigger guard 20. Means for projecting a focused electromagnetic beam 22 are provided, the projecting means 24 being mounted within the barrel 16. In a preferred embodiment the projecting means includes an infrared emitting diode 26 and focusing lenses 28 and 30, a relatively narrow beam of infrared light being projected when the trigger 18 is pulled. The gun may also include a speaker mounted behind a speaker grill 32, and lights in the form of Light Emitting Diodes (LED's) 34. In addition, the handle is also provided with a battery pack receiving chamber for receiving batteries 36. The batteries may be of any desired type, such as rechargeable NiCad batteries.

Figure 5:
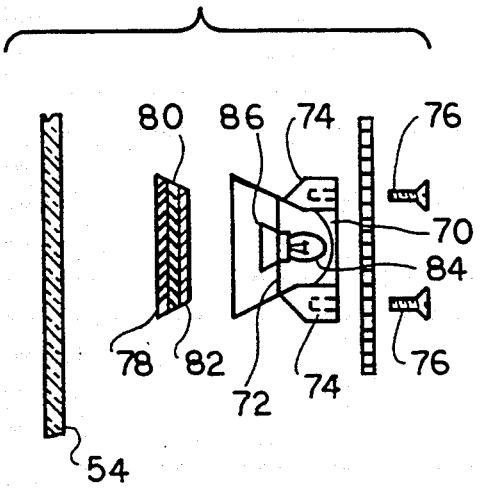
FIG. 5 is an exploded view of a portion of the structure shown in FIG. 4, this view being taken generally along the line 5—5 in FIG. 4.
Figure 6:
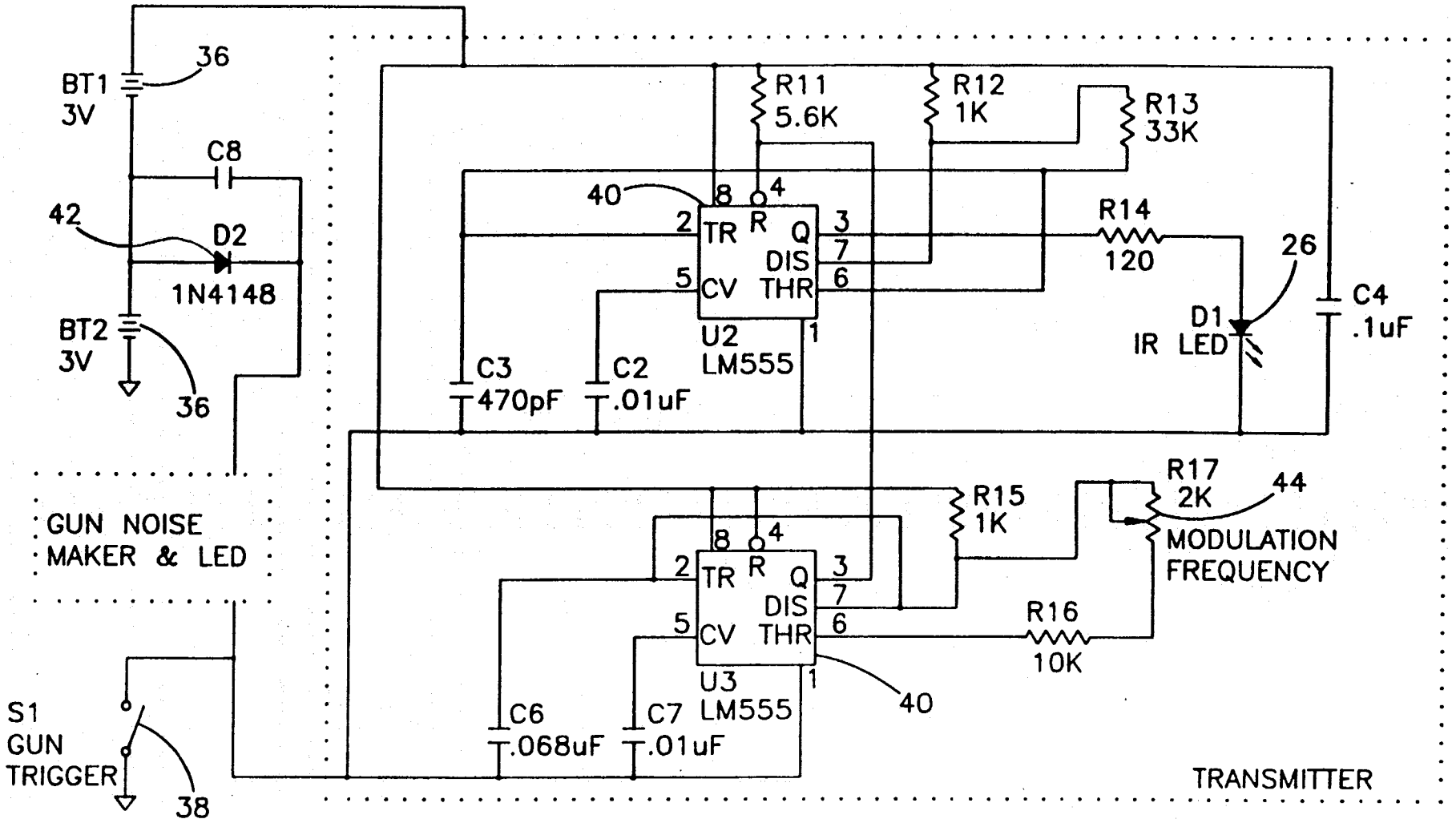
FIG. 6 is an electrical schematic of the electronics which may be employed in the gun shown in FIG. 2.

In a preferred embodiment, the gun will project an amplitude-modulated infrared light beam. The circuit utilized for projecting this beam, and for other purposes is shown in FIG. 6. The circuit includes, in addition to the infrared light emitting diode 26 and the batteries 36, a gun trigger switch 38, two LM555 integrated circuit timing devices 40, a 1N4148 diode 42, a 2K variable resistor 44, and various other resistors and capacitors whose values are shown in FIG. 5. In addition, the circuit will also include a gun noise maker in the form of a speaker, which will be mounted behind the speaker grill 32, and the LED's 34. This portion of the circuit is not illustrated as per se it forms not part of the present invention. It should be noted that the purpose of the timers 40 is to limit the length of time the amplitude-modulated infrared light beam is projected by the ray gun. The gun is operated simply by pulling the trigger which will close switch 38, causing the beam of light to be projected for a brief period of time while at the same time, or perhaps for a longer duration of time, projecting a suitable sound through the speaker grill 32 and causing the LED's 34 to flash.

With reference now to FIGS. 3–5 and 7, the target assembly 12 of this invention includes a case having a base portion 46 and a movable portion 48 hinged to the base portion by conventional hinge means not shown. The movable portion 48 can be moved forwardly and down to a closed position in the same manner that the movable screen portion of a lap-top computer can be moved to its closed position. The movable portion 48 can also be opened to the position shown in FIG. 1 when it is desired to play a game. While a table top model of the target game apparatus is shown in the drawings, it should be appreciated that other designs may be developed. Thus, for example, the target assembly could be floor mounted. Alternatively, it could even be wall mounted, in which situation all of the electronics would be mounted in that portion which corresponds to the movable portion shown in the various figures of this application. As shown, the base is provided with a battery compartment for the reception of a pair of batteries 50. While a pair of batteries are shown in this drawing, it should be appreciated that other energy sources may be employed, such as house current. The base 46 may also include a circuit board on which are mounted various electronic components, in which case the electronics will be connected to the movable portion by a suitable bus 52.

Figure 4:
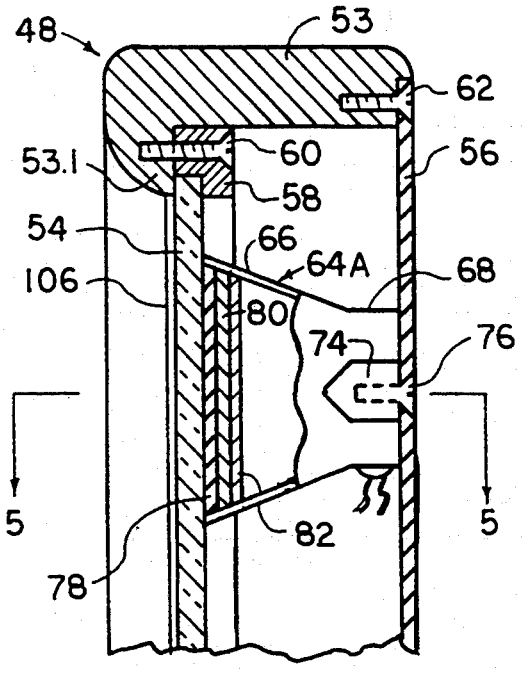
FIG. 4 is a section taken generally along the line 4—4 in FIG. 3.

As shown in FIG. 4 the movable portion 48 is provided with circumferentially extending mounting portion 53, a front target panel 54, and aback 56. In the embodiment shown, the target panel 54 is formed from a single sheet of transparent acrylic plastic. The target panel may be secured in place by a retainer ring 58 which is secured to the mounting portion 53 by screws 60. As can be seen the target panel will be trapped between the overhanging lip 53.1 of the mounting portion and the retainer ring 58. The back 56 is also secured to the mounting portion 53 by screws 62.

A plurality of reflector housings 64 are employed, one of which is indicated generally at 64A in FIG. 4. The reflector housings are mounted to the back panel 56. Each of the reflector housings is provided with a tapered portion 66 and a cylindrical portion 68. The tapered portion is be provided with reflective material on its inside surface. In addition, reflective insert 70 may be positioned in the bottom of the cylindrical portion. A spider 72 extends across the bottom of the tapered portion, the spider in turn carrying illuminating means and receiving means which will be described later. The reflector housing further includes a pair of opposed bosses 74 mounted to either side of the cylindrical portion 68. The bosses are designed to receive mounting screws 76 which are used for mounting the reflector housings on the back 56. In the embodiment shown in this application, the reflector housing 64 is provided with a lens 78, the back of the lens is provided with a two-way mirror 80. A target 82 in the form of a transparent image is in turn mounted behind the two-way mirror. The two-way mirror 80 may be formed integrally with the lens 78, or it may be separate. In either case, it consists of a thin metal coating on the back side of a clear transparent material, the coating being sufficiently thick that it will reflect an image when viewed from the front, but which will permit light to project through the coating when the light behind the glass or mirror 80 is brighter than the light in front of the mirror. While the mirror is shown as being mounted within the reflector housing, it could in fact be formed on the back of the acrylic sheet 54. If the acrylic sheet carries the two-way mirror, the target image may also be printed on the back of the mirror at suitable locations. In any event, reflector housings will be used for each individual target.

As previously noted, a spider is mounted in each reflector housing. Mounted on the back of the spider is illuminating means 84, which may be a standard incandescent light bulb. When the bulb is turned on, the light from the bulb will reflect from the reflective insert 70 and pass through the spider to illuminate the target image 82. Mounted on the front of the spider 72 is receiving means 86. If the electromagnetic beam 22 projected by the gun 10 is an infrared light beam, the receiving means will be an infrared receiver. As the gun circuitry disclosed in FIG. 6 will project an amplitude-modulated infrared light beam, the infrared receiver will be designed to decode the high frequency amplitude-modulated light beam and to transmit to a tone decode 88 any remaining low frequency amplitude modulation information. By using this design there is good rejection of other information received by the receiver. As can be seen from FIG. 3, the targets, which are indicated by the size of the reflector housings, can be of differing shapes. Thus, the tapered portion 66 could be circular in cross section, or it could also be rectangular or square in cross section where it terminates against the target panel 54. In any event different size targets may be seen by the player P when the illuminating means within a housing is caused to be operated.

In operation, the player P will engage the push button 90 to initiate operation of the device. When the button 90 is pushed, it will initiate a flow of current through an integrated circuit 92, which circuit includes a first timer operable to cause a normally open switch 93 to be closed via a relay circuit 94 for only a limited period of time, for example two minutes, after which time the first timer will cause the game to be over. The integrated circuit 92 also contains first switching means for initiating the operation of selected illumination means 84 during the operation of the target assembly, the selected illumination means being operated for short time intervals, for example in the range of one to three seconds. The actual time duration of illumination can be varied by a manually operated second switching means 95 which can vary the time interval that each of the illumination devices will be on. For example, the player may select the expert level where the target will only be illuminated for one second, the rookie level where the target will be illuminated for perhaps three seconds, or an intermediate level. (The actual times of operation set forth above are for purposes of example only.)

Figure 7:
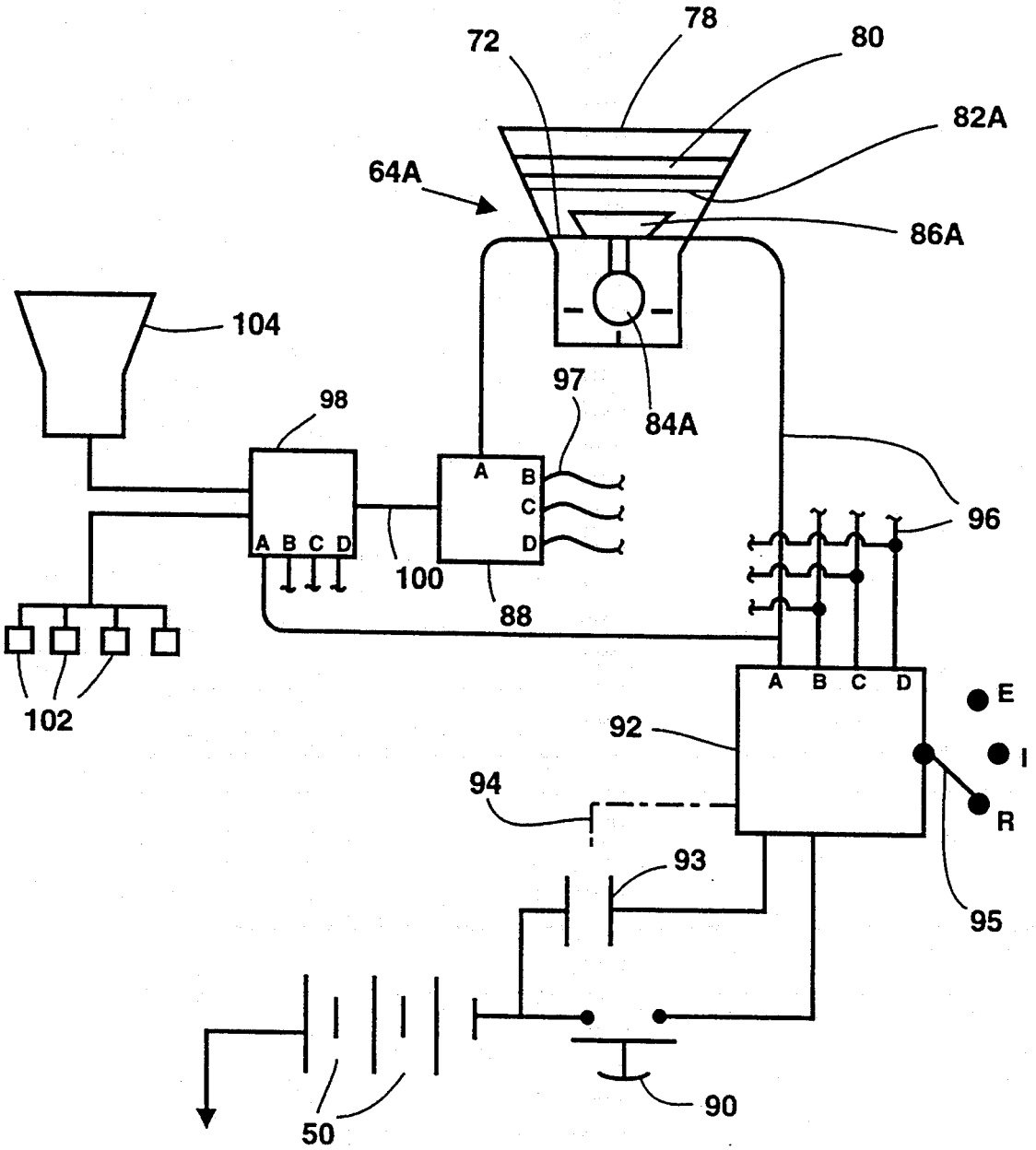
FIG. 7 is an electronic block diagram of the electronics which may be used with the target assembly of FIG. 3.

The first switching means within the integrated circuit 92 will cause current to flow on a selected basis through various leads 96A, 96B, etc. to the various reflector housings, reflector housing 64A also being shown in FIG. 7. When the switching means within the integrated circuit 92 cause current to flow through lead 96A the illuminating means 84A will be lit, which will make the target 82A visible, and the receiving means 86A will also be made operational during the same time interval. If a beam of light should strike the receiver 86A when the associated target 82A is illuminated, a signal will be sent from the receiving means 86A to the tone decoder via a lead 97. The tone decoder is also coupled to other receiving means in other reflector housings by other leads 97. The tone decoder will in turn transmit a signal to a target display and sound circuit integrated circuit 98 via a signal carrier 98. The integrated circuit 100 will also be coupled to the timing and switching integrated circuit 92 so that the target display and sound circuit can compare the signal received from the tone decoder with information concerning which target was on display. After comparing this information it can register a score through indicia 102 (which may be liquid crystal displays) and broadcast a sound through a speaker 104, both the indicia indicating a score appropriate to the particular target being hit, and the speaker broadcasting a suitable sound for the target being hit. The speaker will be positioned behind a speaker grill 106 on the target panel 54.

In the design illustrated a single acrylic sheet is utilized for the target panel. As the individual reflector housings which establish the targets to be hit are mounted on the back panel, it can be seen that differing target arrays can be readily achieved by varying the location of the reflector housings. In order to improve the appearance of the target game apparatus, a background graphic 106 (FIG. 4) may be printed on the front of the acrylic screen.

In an alternate embodiment, not illustrated, the target panel may be a board, such a cardboard, which is provided with die cut apertures. In this event, the reflector housings will be positioned so that the lens of each reflector housing is in a suitable aperture in the die cut board. Background graphics may also be placed upon the board. In addition, the receiving means may be positioned in a cutout adjacent the reflector housings, rather than being carried by a spider within the reflector housing.

It can be seen from the foregoing that applicant has achieved the action of a shooting gallery which has formerly only been available through a video arcade game. In applicant's game, a relatively low cost alternative approach has been achieved by mounting electromagnetic receivers adjacent individual targets which are only visible when illuminated.

While a preferred form of this invention has been described above and shown in the accompanying drawings, it should be understood that the applicant does not intend to be limited to the particular details described above and illustrated in the accompanying drawings, but intends to be limited only to the scope of the invention as defined by the following claims.

What is claimed is:

1. A target game apparatus comprising the combination of:

a device for projecting an electromagnetic beam; and a target assembly having a case the case including a base portion and a movable portion hinged to the base, and the base portion capable of being supported on a table top or the like so that a player may play the game when either standing or sitting;

a target panel supported by the movable portion of the case, the panel having a front generally planar surface and a back surface, a plurality of targets supported on or behind the back surface of the target panel, illumination means for illuminating an associated target to cause the associated target to be visible, the target not being visible when the illumination means is not operated, first timer means for initiating operation of the target assembly for a first time period, first switching means for initiating the operation of selected illumination means during operation of the target assembly, the selected illumination means being operated for a time interval less than the first time period, receiving means associated with each target, each receiving means initiating a signal during operation of the associated illumination means when the receiving means is struck by the electromagnetic beam projected by the device, and scoring means carried by the target assembly for displaying a score in response to signals received from each receiver.

2. A target game apparatus comprising the combination of:

a device for projecting an electromagnetic beam; and a target assembly having a target panel having a front generally planar surface and a back surface, a plurality of targets supported on or behind the back surface of the target panel, illumination means for illuminating an associated target to cause the associated target to be visible, the target not being visible when the illumination means is not operated, a two-way mirror positioned in front of each of the targets, the two-way mirror concealing the target except when the associated illumination means is caused to be operated, first timer means for initiating operation of the target assembly for a first time period, first switching means for initiating the operation of selected illumination means during operation of the target assembly, the selected illumination means being operated for a time interval less than the first time period, receiving means associated with each target, each receiving means initiating a signal during operation of the associated illumination means when the receiving means is struck by the electromagnetic beam projected by the device, and scoring means carried by the target assembly for displaying a score in response to signals received from each receiver.

3. The target game apparatus as set forth in claim 2 wherein the target panel is formed from a single acrylic sheet, the back side of which is covered with the two-way mirror.

4. The target game apparatus as set forth in claim 2 wherein the target panel is formed from a board having a plurality of cut-outs, lenses being mounted in each of the cut-outs, the back side of each lens being covered with a portion of the two-way mirror, and one of the targets being associated with each of the lenses.

5. The target game apparatus as set forth in claim 4 wherein each of the lenses is supported by a reflector housing, and wherein an illumination means and a receiving means is mounted within each reflector housing.

6. A target game apparatus comprising the combination of:

a device for projecting an electromagnetic beam; and a target assembly having a case, a target panel having a front generally planar surface and a back surface, a plurality of targets supported on or behind the back surface of the target panel, the target panel being on the front of the case, the case further including a back, a plurality of reflector housings carried by the back, illumination means for illuminating an associated target to cause the associated target to be visible, the target not being visible when the illumination means is not operated, first timer means for initiating operation of the target assembly for a first time period, first switching means for initiating the operation of selected illumination means during operation of the target assembly, the selected illumination means being operated for a time interval less than the first time period, receiving means associated with each target, each receiving means initiating a signal during operation of the associated illumination means when the receiving means is struck by the electromagnetic beam projected by the device, wherein the illumination means and the receiving means for each target is mounted within the reflector housing, and scoring means carried by the target assembly for displaying a score in response to signals received from each receiver.

7. The target game apparatus as set forth in claim 6 wherein each reflector housing including a lens and target behind the lens.

8. A target game apparatus comprising the combination of:

a device for projecting an electromagnetic beam; and a target assembly having a target panel having a front generally planar surface and a back surface, a plurality of targets supported on or behind the back surface of the target panel, illumination means for illuminating an associated target to cause the associated target to be visible, the target not being visible when the illumination means is not operated, first timer means for initiating operation of the target assembly for a first time period, first switching means for initiating the operation of selected illumination means during operation of the target assembly, the selected illumination means being operated for a time interval less than the first time period, the switching means being capable of operating the illumination means either individually or sometimes in pairs, receiving means associated with each target, each receiving means initiating a signal during operation of the associated illumination means when the receiving means is struck by the electromagnetic beam protected by the device, and scoring means carried by the target assembly for displaying a score in response to signals received from each receiver.

* * * * *